US010987788B2

(12) United States Patent
Andrews

(10) Patent No.: US 10,987,788 B2
(45) Date of Patent: Apr. 27, 2021

(54) SYSTEMS AND METHODS FOR REMOVING BEARING CUPS

(71) Applicant: Tiger Tool International Incorporated, Abbotsford (CA)

(72) Inventor: Michael Andrews, Bellingham, WA (US)

(73) Assignee: TIGER TOOL INTERNATIONAL INCORPORATED, Abbotsford (CA)

( * ) Notice: Subject to any disclaimer, the term of this patent is extended or adjusted under 35 U.S.C. 154(b) by 129 days.

(21) Appl. No.: 16/122,750

(22) Filed: Sep. 5, 2018

(65) Prior Publication Data

US 2019/0070716 A1 Mar. 7, 2019

Related U.S. Application Data

(60) Provisional application No. 62/554,465, filed on Sep. 5, 2017.

(51) Int. Cl.
*B25B 27/06* (2006.01)

(52) U.S. Cl.
CPC ..... *B25B 27/062* (2013.01)

(58) Field of Classification Search
CPC ..... B25B 27/062; B25B 27/023; B23Q 3/00; B23P 11/00; B23P 11/027; B23P 9/04;
(Continued)

(56) References Cited

U.S. PATENT DOCUMENTS 1,334,658 A 3/1920 Koch
1,429,567 A * 9/1922 Carlisle ..... B25B 27/023 29/262

(Continued)

FOREIGN PATENT DOCUMENTS

DE 20113561 U1 11/2001
EP 2461061 A2 6/2012

(Continued)

OTHER PUBLICATIONS

International Searching Authority, ISR & Written Opinion, PCT/US2015/057201, dated Dec. 22, 2015, 9 pages.

(Continued)

*Primary Examiner* — Lee D Wilson
*Assistant Examiner* — Seahee Hong
(74) *Attorney, Agent, or Firm* — Michael R. Schacht; Schacht Law Office, Inc.

(57) ABSTRACT

A bearing cup removal tool for removing a bearing cup from a bearing casting comprises a collar assembly and a displacing assembly. The collar assembly comprises a clamp member and a clamp assembly, where the clamp member defines a clamp surface. The clamp assembly deforms the clamp member to alter a shape of the clamp surface such that the clamp member may be configured to surround at least a portion of the bearing cup and the clamp member may be configured to frictionally engage at least a portion of the bearing cup to secure the clamp member to the bearing cup. The displacing assembly engages the clamp member and is adapted to engage the bearing casting such that operation of the displacing assembly forces the clamp member away from the bearing casting.

13 Claims, 17 Drawing Sheets

(58) Field of Classification Search
CPC ..... Y10T 29/53878; Y10T 29/53883; Y10T 29/53104; Y10T 29/53683; Y10T 29/53796; Y10T 29/53857
USPC ..... 29/252, 224, 278, 251, 255, 262
See application file for complete search history.

(56) References Cited

U.S. PATENT DOCUMENTS

| | | | | | |
|---|---|---|---|---|---|
| 1,650,964 | A | * | 11/1927 | Schmitt | B25B 27/023 29/262 |
| 1,778,802 | A | * | 10/1930 | Howell | B25B 27/062 29/262 |
| 1,990,570 | A | * | 2/1935 | Smith | B25B 27/062 29/262 |
| 2,755,540 | A | | 7/1956 | Crozier | |
| 3,336,652 | A | | 8/1967 | Andre | |
| 3,964,149 | A | * | 6/1976 | Hugh | B25B 27/023 29/261 |
| 4,034,458 | A | | 7/1977 | Ford et al. | |
| 4,691,424 | A | * | 9/1987 | Schmidt | B25B 27/023 29/261 |
| 4,769,890 | A | | 9/1988 | Maynard | |
| 5,255,435 | A | * | 10/1993 | Shultz | B25B 27/023 29/259 |
| 5,787,561 | A | | 8/1998 | Armand | |
| 7,707,709 | B2 | | 5/2010 | Whitehead | |
| 9,808,922 | B2 | * | 11/2017 | Breschi | F04B 39/10 |
| 2017/0209994 | A1 | | 7/2017 | Hargrove et al. | |
| 2017/0297152 | A1 | | 10/2017 | Andrews | |
| 2017/0307020 | A1 | | 10/2017 | Andrews | |

FOREIGN PATENT DOCUMENTS

| | | | |
|---|---|---|---|
| JP | 104800 | | 9/1974 |
| JP | 192877 | | 12/1987 |
| RU | 2028933 | C1 | 2/1995 |
| SU | 1207744 | A | 1/1986 |
| SU | 1632766 | A1 | 3/1991 |
| WO | 2011012552 | A1 | 2/2011 |
| WO | 2017181078 | | 10/2017 |
| WO | 2019050989 | A1 | 3/2019 |

OTHER PUBLICATIONS

International Searching Authority, ISR & Written Opinion, PCT/US2017/027724, dated Aug. 17, 2017, 7 pages.
International Searching Authority, ISR & Written Opinion, PCT/US2018/049608, dated Dec. 6, 2018, 8 pages.

* cited by examiner

SYSTEMS AND METHODS FOR REMOVING BEARING CUPS

RELATED APPLICATIONS

This application, U.S. patent application Ser. No. 16/122,750 filed Sep. 5, 2018, claims benefit of U.S. Provisional Application Ser. No. 62/554,465 filed Sep. 5, 2017, the contents of which are incorporated herein by reference.

TECHNICAL FIELD

The present invention relates to the disassembly of bearing assemblies and, in particular, to systems and methods for removing a bearing cup from a bearing casting of a bearing assembly.

BACKGROUND

The rebuilding of a bearing assembly requires the removal of a bearing cup from a bearing casting. Removal of the bearing cup from a bearing casting without damaging the bearing cup or the bearing casting can be difficult because typically only a small portion of the bearing cup is accessible when the bearing cup is fully received by the bearing casting.

The need thus exists for improved systems and methods for removing a bearing cup from a bearing casting.

SUMMARY

The present invention may be embodied as a bearing cup removal tool for removing a bearing cup from a bearing casting comprising a collar assembly and a displacing assembly. The collar assembly comprises a clamp member and a clamp assembly, where the clamp member defines a clamp surface. The clamp assembly deforms the clamp member to alter a shape of the clamp surface such that the clamp member may be configured to surround at least a portion of the bearing cup and the clamp member may be configured to frictionally engage at least a portion of the bearing cup to secure the clamp member to the bearing cup. The displacing assembly engages the clamp member and is adapted to engage the bearing casting such that operation of the displacing assembly forces the clamp member away from the bearing casting.

The present invention may be embodied as a method of removing a bearing cup from a bearing casting comprising the following steps. A clamp member defining a clamp surface is provided. A clamp assembly is operatively connected to the clamp member to define a collar assembly. The clamp assembly is operated to deform the clamp member to alter a shape of the clamp surface such that the clamp member may be configured to surround at least a portion of the bearing cup. The clamp assembly is operated such that the clamp member frictionally engages at least a portion of the bearing cup to secure the clamp member to the bearing cup. A displacing assembly adapted to engage the bearing casting is provided. The displacing is arranged assembly to engage the clamp member and the bearing casting. The displacing assembly is operated to force the clamp member away from the bearing casting.

The present invention may be embodied as a bearing cup removal tool for removing a bearing cup from a bearing casting comprising a collar assembly and a displacing assembly. The collar assembly comprises a clamp defining a split gap and a clamp surface and a clamp bolt arranged across the split gap. Rotation of the clamp bolt in a first direction relative to the clamp member deforms the clamp member to alter a shape of the clamp surface such that the clamp member may be configured to surround at least a portion of the bearing cup. Rotation of the clamp bolt in a second direction relative to the clamp member deforms the clamp member to alter a shape of the clamp surface such that the clamp member frictionally engages at least a portion of the bearing cup to secure the clamp member to the bearing cup. The displacing assembly engages the clamp member and is adapted to engage the bearing casting such that operation of the displacing assembly forces the clamp member away from the bearing casting.

DETAILED DESCRIPTION

Figure 1:
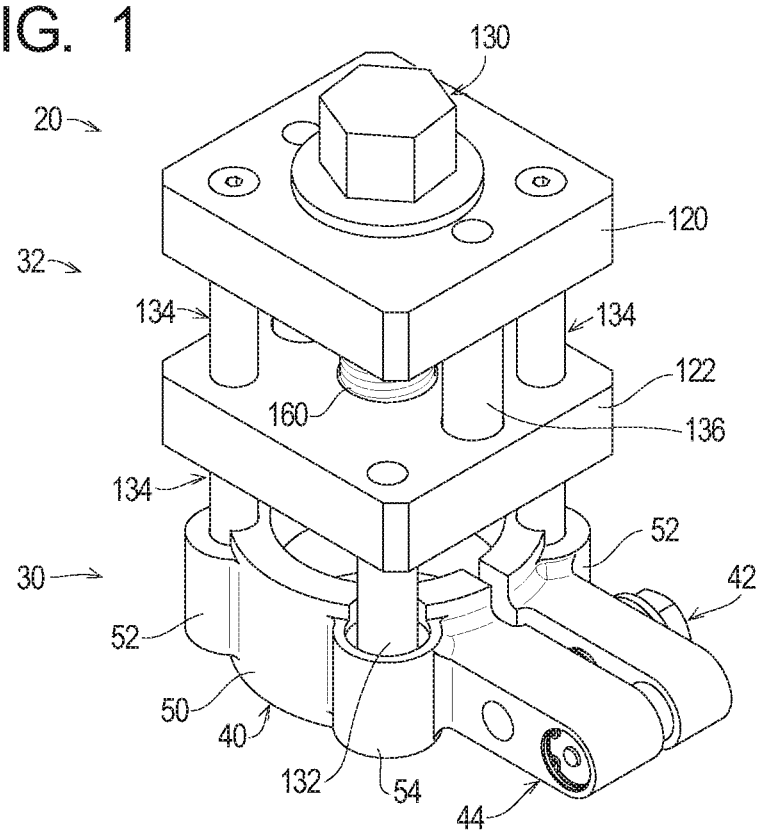
FIG. 1 is a top perspective view of a first example bearing cup removal tool of the present invention.
Figure 2:
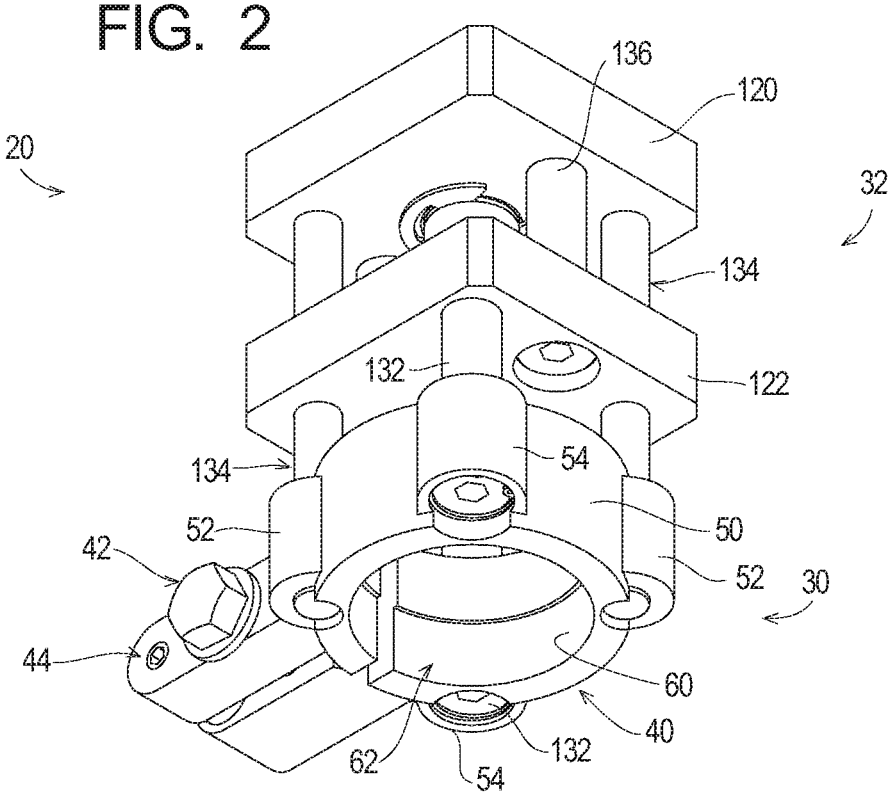
FIG. 2 is a bottom perspective view of the first example bearing cup removal tool.

The present invention may take a number of forms, and two examples of bearing cup removal tools constructed in accordance with the principles of the present invention will be described separately below.

I. First Example Bearing Cup Removal Tool

Referring initially to FIGS. 1-7 of the drawing, depicted therein is the basic construction and use of a first example bearing cup removal tool 20 of the present invention. FIGS. 3-7 illustrate that the first example bearing cup removal tool 20 may be used to remove a bearing cup 22 of a bearing cup assembly 24. The bearing assembly 24 is not per se part of the present invention and will be described herein only to that extent necessary for a complete understanding of the present invention.

Figure 3:
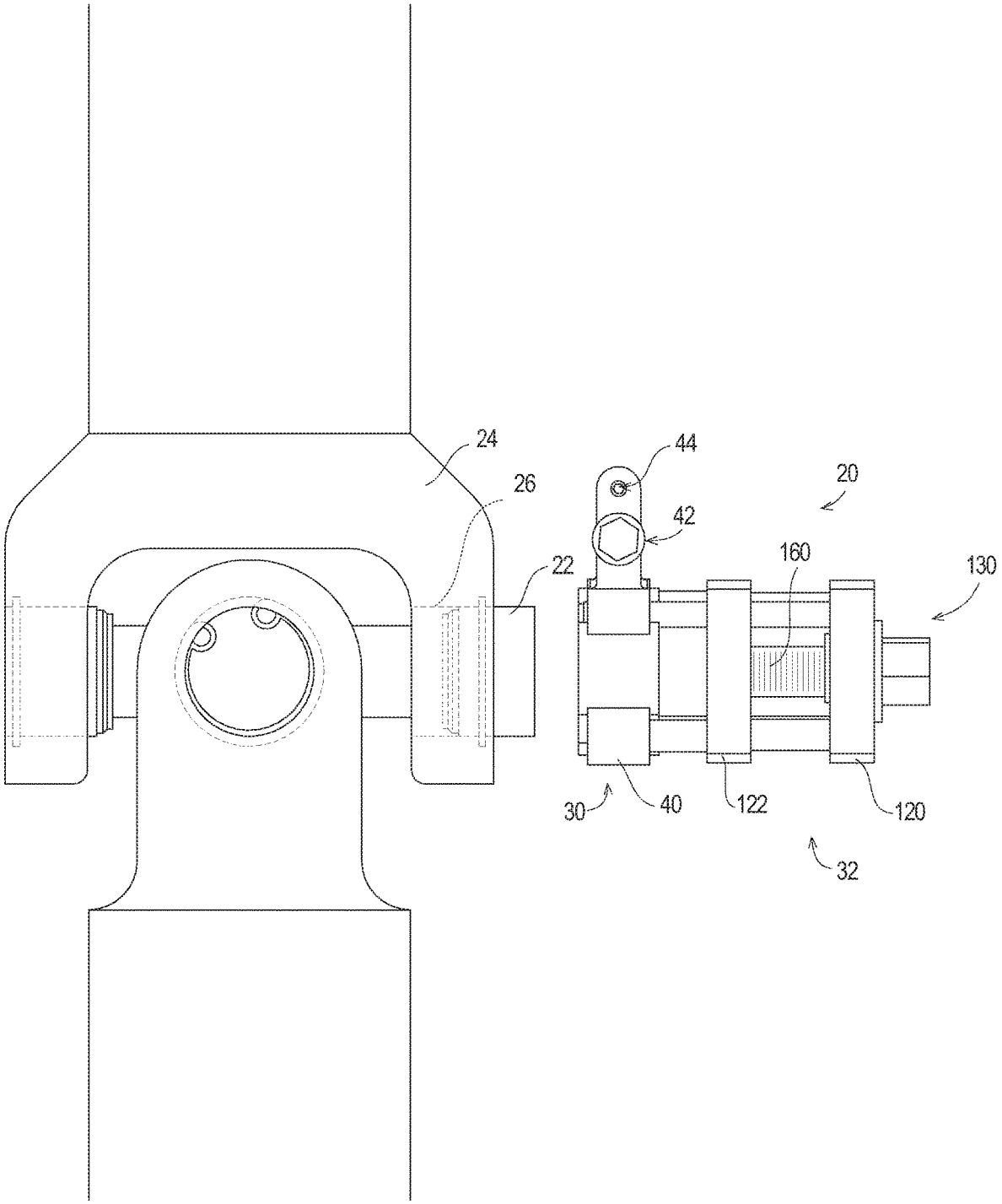
FIG. 3 is a plan view depicting a first step in a method of using the first example bearing cup removal tool to remove a bearing cup from a bearing assembly.

The example bearing assembly 24 comprises a bearing casting 26 defining a bearing cup opening 28. When fully assembled, the bearing cup 22 resides within the bearing cup opening 28. During the process of disassembling the bearing assembly 24, the bearing cup 22 is displaced relative to the bearing casting 26 such that the bearing cup 22 partly protrudes from the bearing cup opening 28 as shown in FIG. 3. The first example bearing cup removal tool 20 is used to remove the bearing cup 22 from the bearing cup opening 28.

Figure 4:
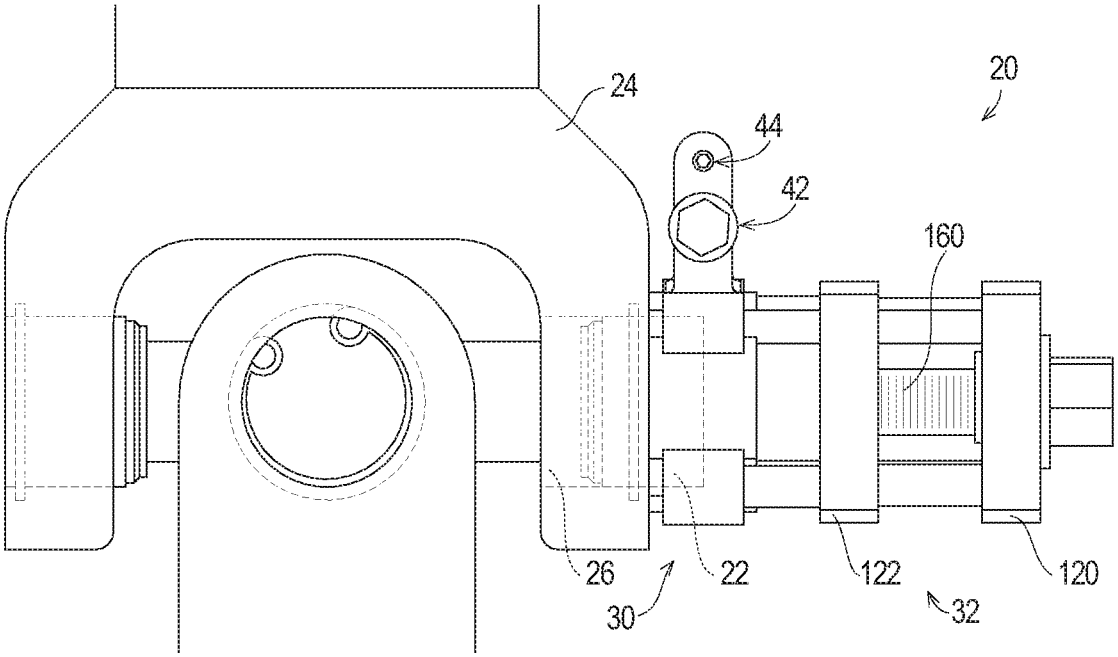
FIG. 4 is a plan view depicting a second step in a method of using the first example bearing cup removal tool to remove the bearing cup.
Figure 5:
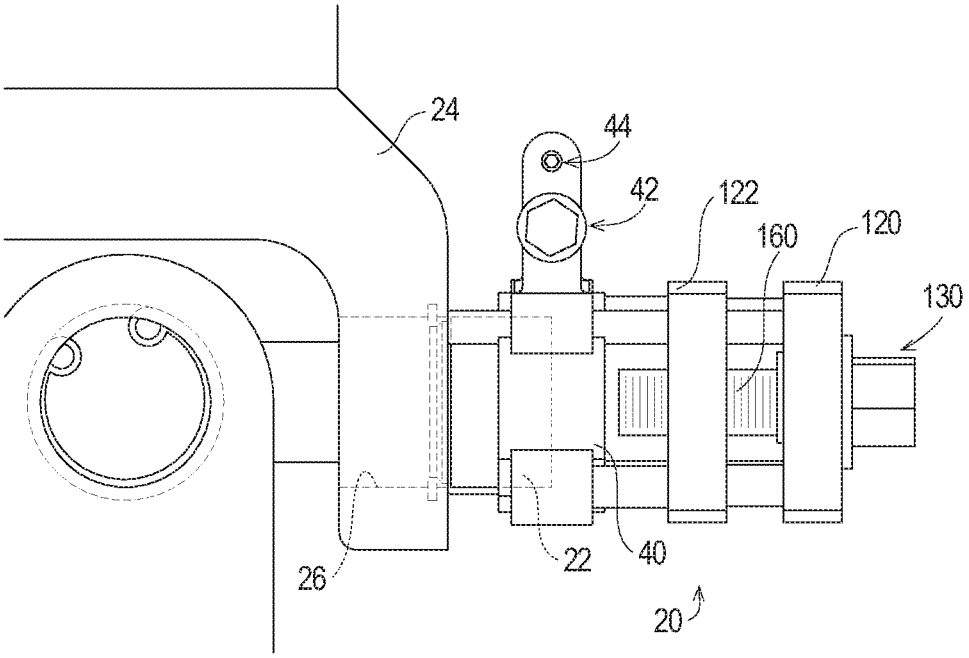
FIG. 5 is a plan view depicting a third step in a method of using the first example bearing cup removal tool to remove the bearing cup.
Figure 6:
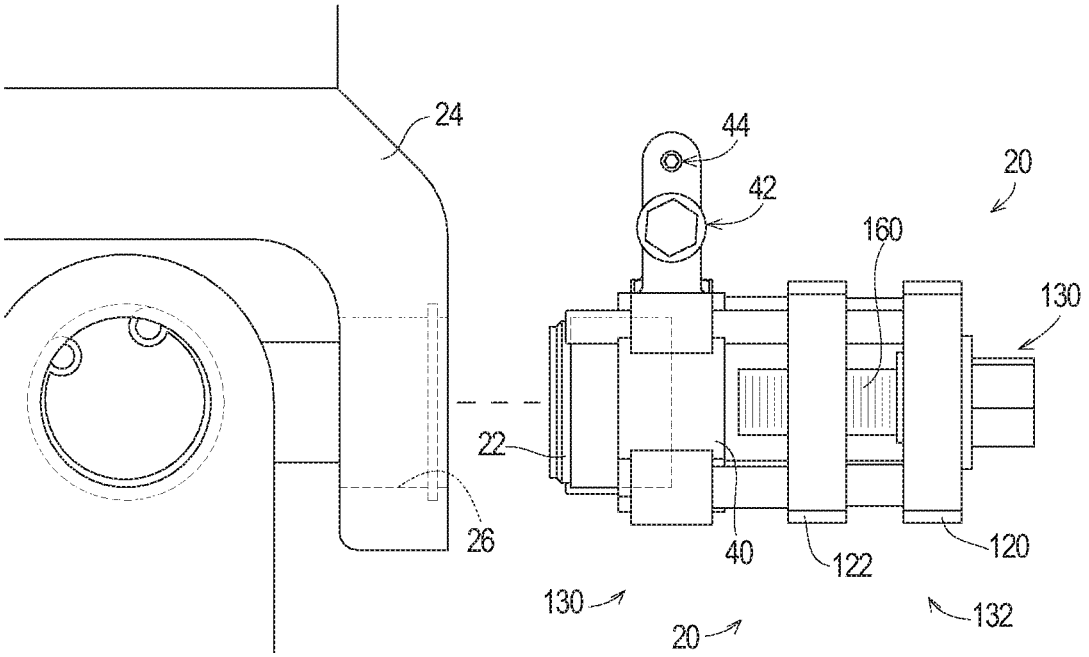
FIG. 6 is a plan view depicting a fourth step in a method of using the first example bearing cup removal tool to remove the bearing cup.
Figure 7:
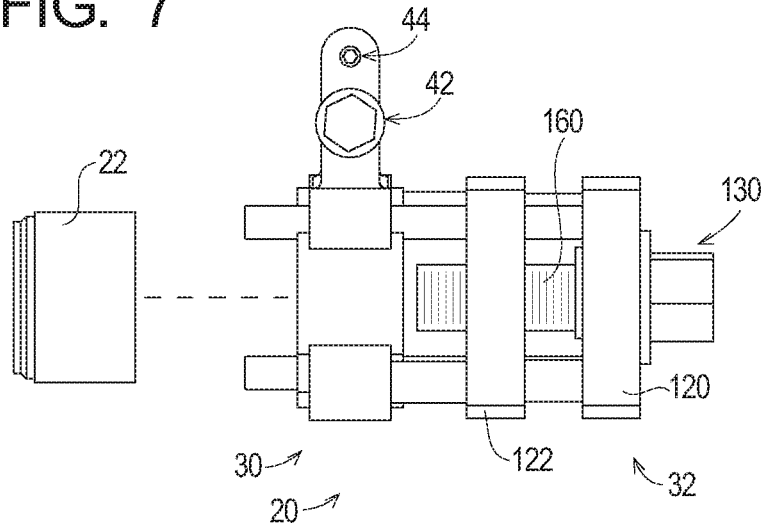
FIG. 7 is a plan view depicting a fifth step in a method of using the first example bearing cup removal tool to remove the bearing cup.
Figure 8:
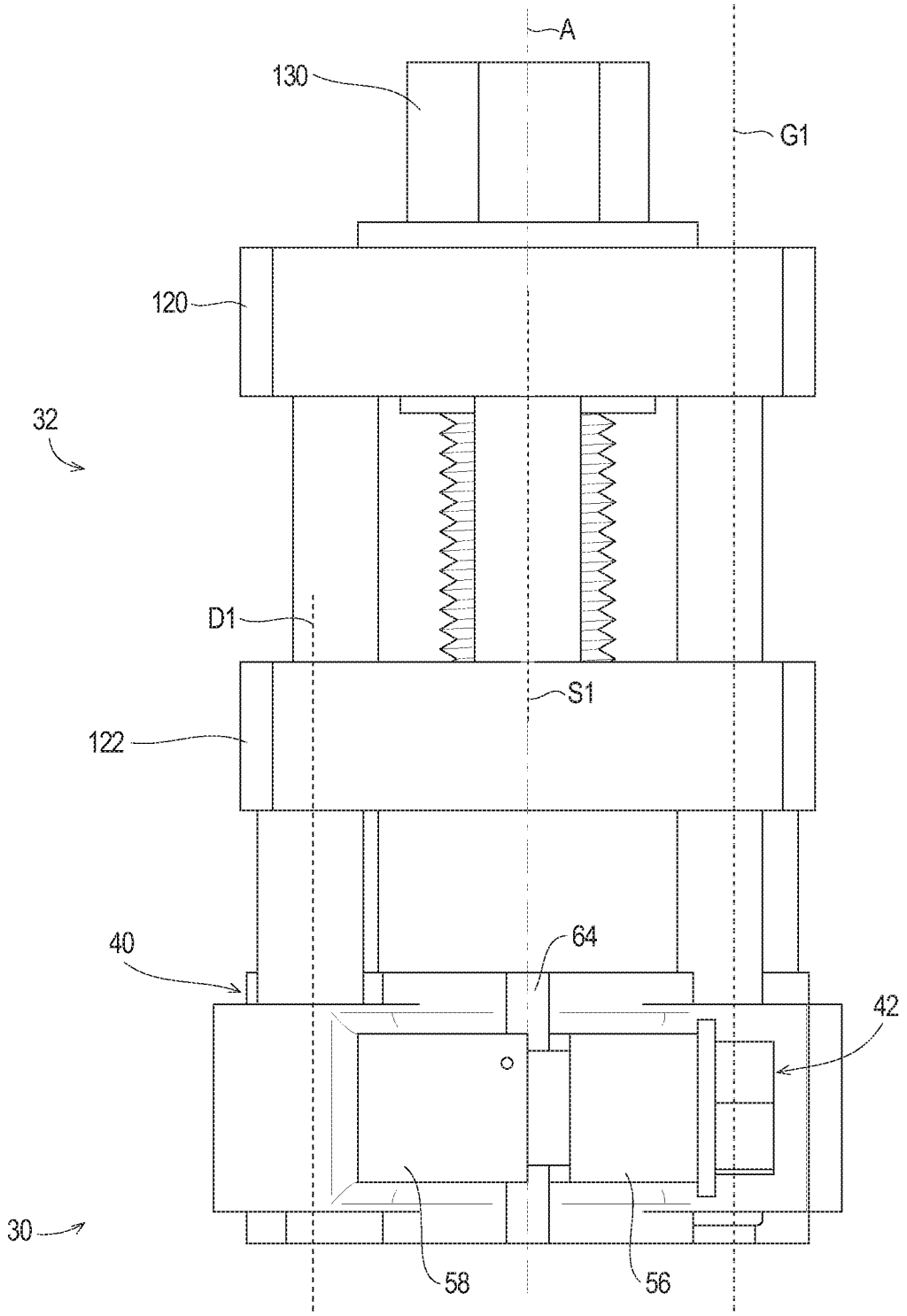
FIG. 8 is a first side elevation view of the first example bearing cup removal tool.
Figure 9:
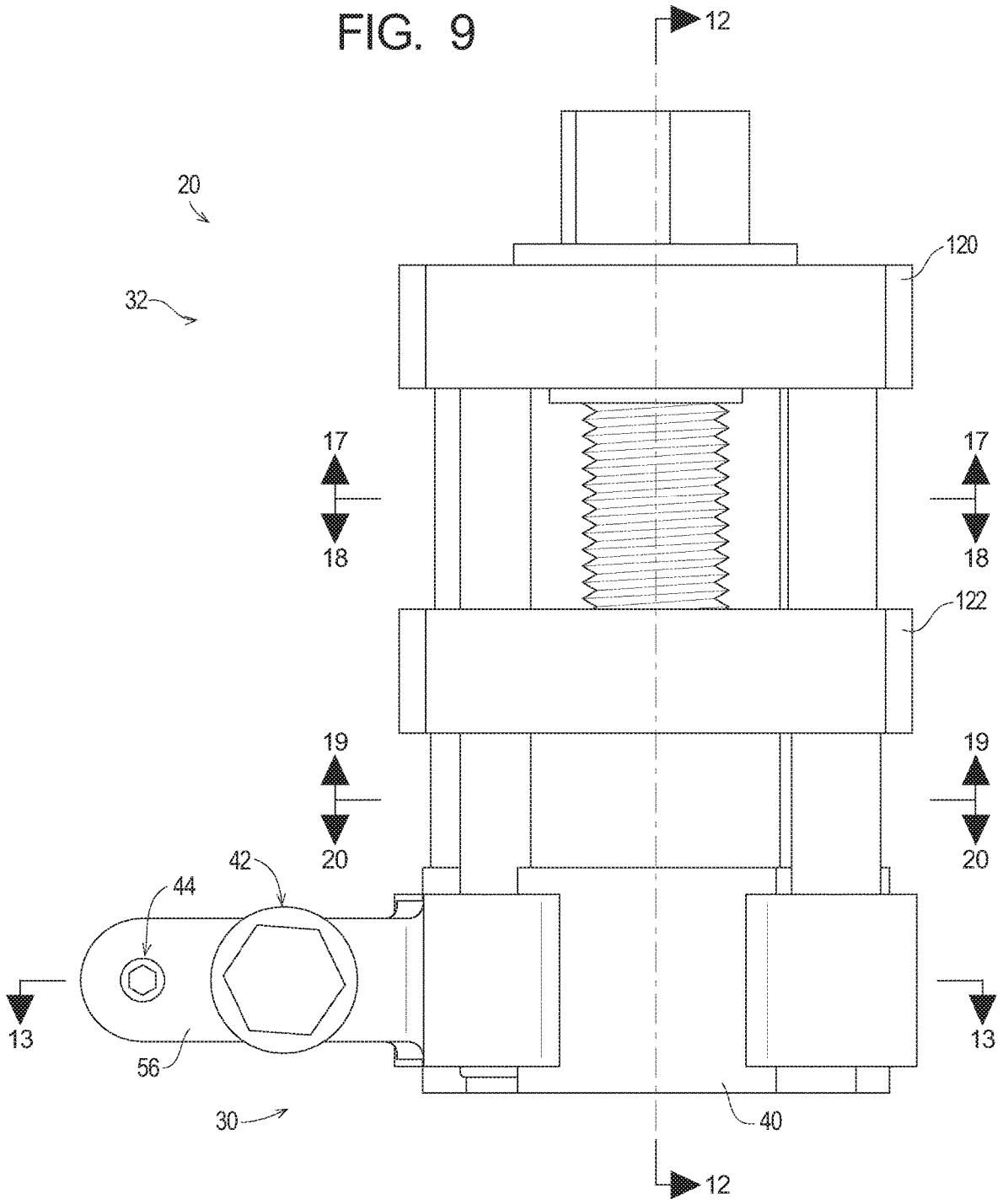
FIG. 9 is a second side elevation view of the first example bearing cup removal tool.
Figure 10:
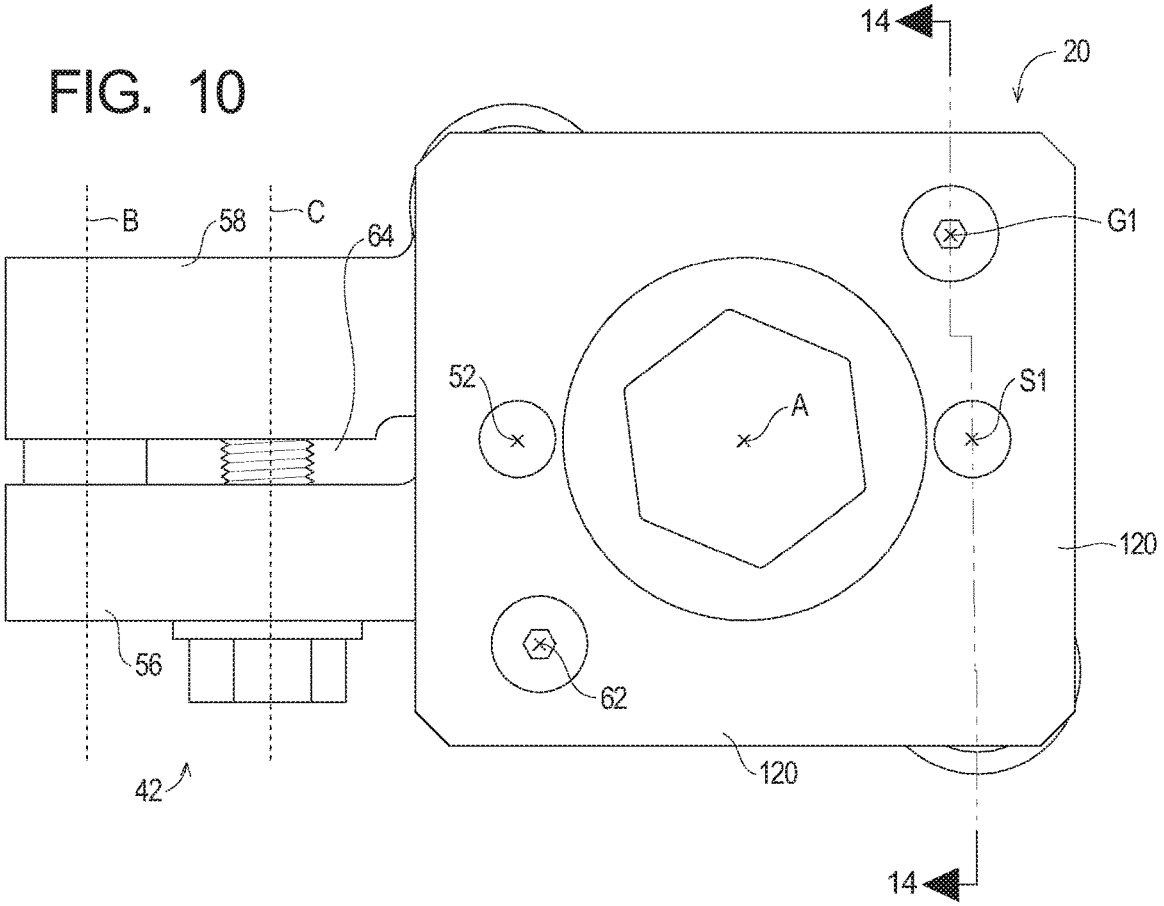
FIG. 10 is a top plan of the first example bearing cup removal tool.
Figure 11:
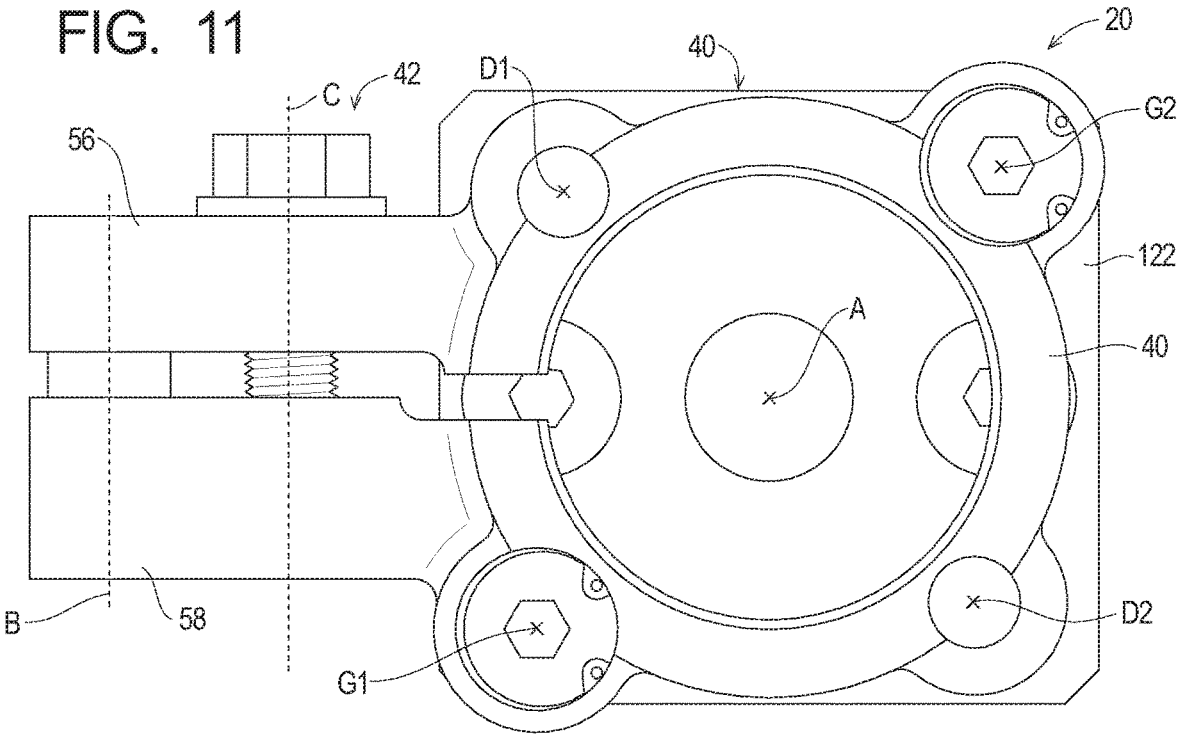
FIG. 11 is a bottom plan of the first example bearing cup removal tool.
Figure 12:
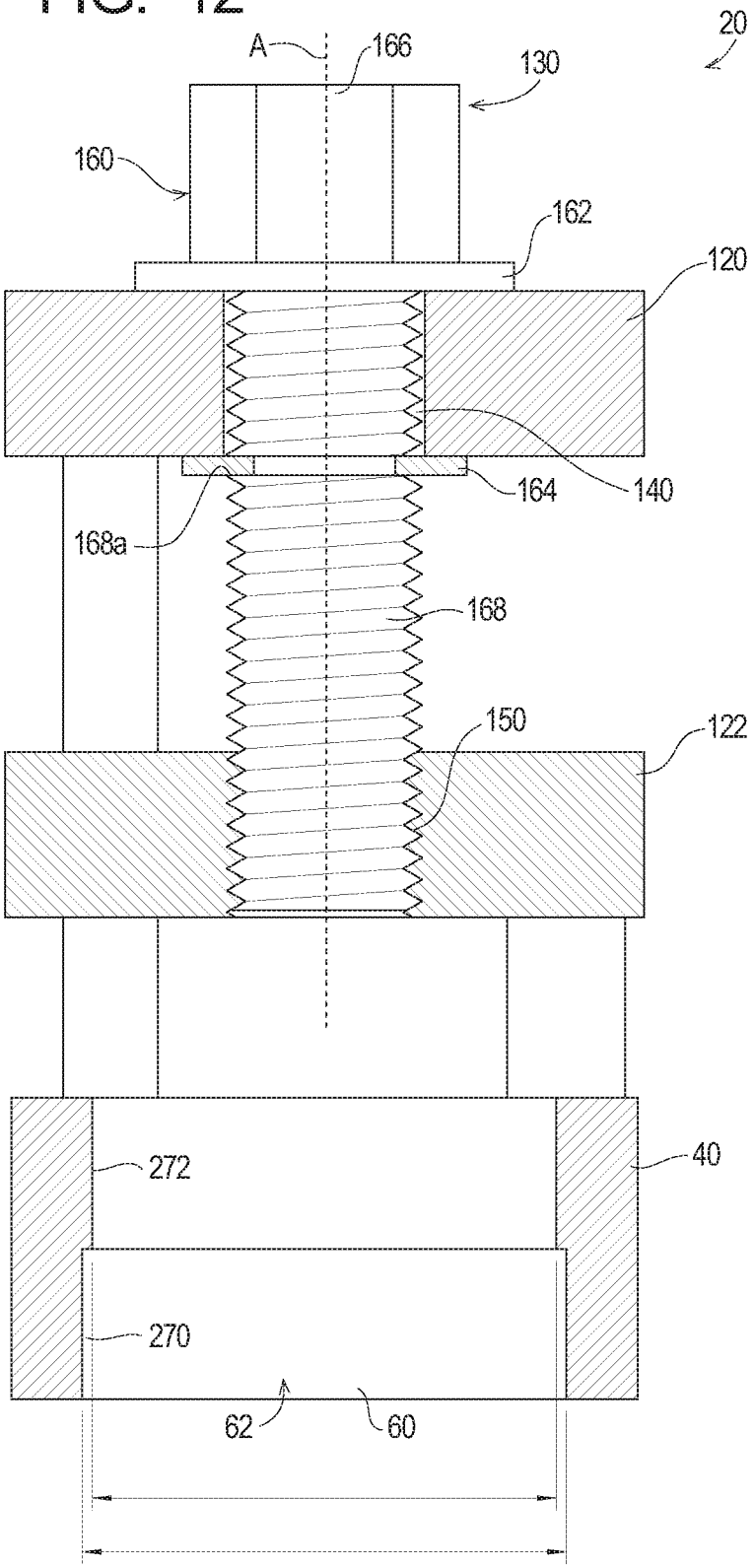
FIG. 12 is a section view taken along lines 12-12 in FIG. 9.

The first example bearing cup removal tool 20 comprises a first example collar assembly 30 and a first example displacing assembly 32. The collar assembly 30 is clamped onto the protruding portion of the bearing cup 22 as shown in FIG. 4, and the first example displacing assembly 32 is operated to displace the bearing cup 22 relative to the bearing casting 26 as shown in FIG. 5 until the bearing cup 22 is completely removed from the bearing cup opening 28 as shown in FIG. 6. The collar assembly 30 is then unclamped from the bearing cup 22 as shown in FIG. 7. The use of the bearing cup removal tool 20 simplifies the process of removing the bearing cup 22 from the bearing cup opening 28 while minimizing or eliminating damage to the bearing cup 22 and the bearing cup casting 26.

With the foregoing general understanding of the principles of the present invention in mind, the details of the first example bearing cup removal tool will now be described with reference to FIGS. 8-20.

A. First Example Collar Assembly

Referring to FIGS. 8-11 and 13, the first example collar assembly 30 will initially be described. The first example collar assembly 30 comprises a clamp member 40, a clamp assembly 42, and, optionally, a bias assembly 44. The clamp member 40 is configured to surround at least a portion of the bearing cup 22. The clamp assembly 42 acts on the clamp member 40 to cause the clamp member to frictionally engage the bearing cup 22. The optional bias assembly 44 allows a configuration of the clamp member 40 to be preset such that the clamp member 40 may easily be arranged to surround at least a portion of the bearing cup 22 prior to operation of the clamp assembly 42.

The details of construction and operation of the first example collar assembly 30 will now be described in further detail.

The example clamp member 40 comprises a main portion 50, at least one brace portion 52, at least one draw portion 54, a first clamp projection 56, and a second clamp projection 58. The main portion of the example clamp member 40 further defines an internal clamp surface 60 defining a clamp opening 62. The example clamp surface 60 is generally cylindrical but is discontinuous at a clamp member split gap 64. The first and second projections 56 and 58 extend from the main portion 50 on either side of the clamp member split gap 64. Each brace portion 52 of the example clamp member 40 defines a brace through opening 66, while each draw portion 54 of the example clamp member 40 defines a draw opening 68. The term "through opening" as used herein refers to an opening, typically cylindrical, in a first member through which a second member passes, but which allows free movement of the second member relative to the first member.

Figure 13:
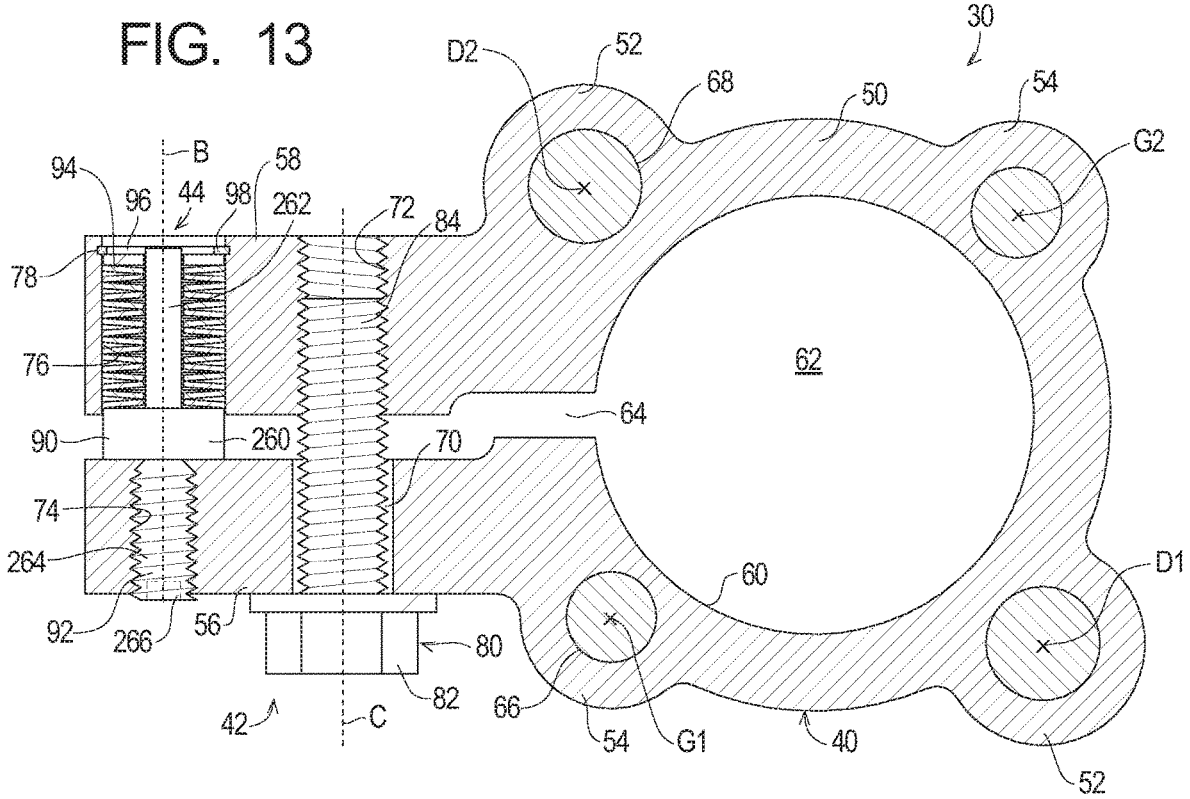
FIG. 13 is a section view taken along lines 13-13 in FIG. 9.

FIG. 13 perhaps best shows that a clamp through opening 70 is formed in the first clamp projection 56 and that a clamp threaded opening 72 is formed in the second clamp projection 58. FIG. 13 also shows that an optional adjustment threaded opening 74 is formed in the first clamp projection 56 and that an optional bias opening 76 is formed in the second clamp projection 58. A bias opening annular recess 78 may be formed in the bias opening 76 as also shown in FIG. 13.

The example clamp assembly 42 comprises a clamp bolt 80 defining a clamp bolt head 82 and a clamp bolt shaft 84. The example clamp bolt shaft 84 is sized and dimensioned to extend through the clamp through opening 70 and is threaded to engage the clamp threaded opening 72. Axial rotation of the clamp bolt 80 relative to the second clamp projection 58 thus displaces the clamp bolt along a clamp axis C relative to the clamp projection 58.

When the clamp bolt head 82 is in contact with the first clamp projection 58, axial rotation of the clamp bolt 80 in a tightening direction displaces the first clamp projection 56 towards to the second clamp projection 58 to reduce a dimension of the clamp member split gap 64 along the clamp axis C, while axial rotation of the clamp bolt 80 in a loosening direction allows the first clamp projection 56 to be displaced away from the second clamp projection 58 to increase a dimension of the clamp member split gap 64 along the clamp axis C. The example clamp member 40 may be sized and dimensioned and made of a resiliently deformable material such as spring steel that will inherently displace the first clamp projection 56 away from the second clamp projection 56 when the clamp bolt 80 is axially rotated in the loosening direction. In addition, the bias assembly 44 may be used to exert a biasing force on the first clamp projection 56 to displace the first clamp projection 56 away from the second clamp projection 58 as will be described below.

The first example collar assembly 30 allows the first example bearing cup puller to be secured onto the bearing cup 22. In particular, the bearing cup 22 is arranged within the clamp opening 62. The clamp bolt 80 is then axially rotated in the tightening direction until the clamp surface 60 is securely held against the bearing cup 22. When the clamp member 40 is sufficiently secured relative to the bearing cup 22, friction between the clamp surface 60 and the bearing cup 22 allows the bearing cup 22 to move with the clamp member 40 as the first example displacing assembly 32 is operated to displace the bearing cup 22 relative to the bearing casting 26 and out of the bearing cup opening 28.

The example optional bias assembly 44 comprises a bias transfer member 90, a bias set screw 92, a biasing member 94, a bias washer 96, and a bias washer retainer 98. The example biasing member 94 is arranged at least partly within the bias opening 76. The bias washer 96 is arranged within the bias opening 76 to engage a first end of the biasing member 94. The bias washer retainer 98 is arranged to engage the bias opening annular recess to inhibit movement of the bias washer 96 in a first direction along a bias axis B relative to the second projection 58. The bias washer 96 thus inhibits movement of the biasinq member 94 in the first direction along the bias axis B. The bias transfer member 90 is arranged to engage a second end of the biasing member 94. The bias set screw 92 is threaded to engage the adjustment threaded opening 74 such that axial rotation of the bias set screw 92 displaces the bias set screw 92 in either direction along the bias axis B.

So configured, axial rotation of the bias set screw 92 to displaces the bias set screw 92 in the first direction along the bias axis B causes the bias set screw 92 to engage the bias transfer member 90. Further axial rotation of the bias set screw 92 to displace the bias set screw 92 in the first direction displaces the bias transfer member 90 in the first direction to force the biasing member 94 against the bias washer 96. At this point, continued axial rotation of the bias set screw 92 to displace the bias set screw 92 in the first direction compresses biasing member 94 such that the biasing member 94 biases the first and second projections away from each other to increase a dimension of the clamp member split gap 64 along the clamp axis C. The example biasing member 94 is a compression spring, but any other resilient member capable of biasing the first and second projections 56 and 58 away from each as described herein may be used as the biasing member 94.

The bias assembly 44 thus may be configured and, optionally, adjusted using the bias set screw 92, such that the first and second clamp projections 56 and 58 are normally forced away from each other a distance appropriate for the clamp opening to accommodate a particular bias cup 22. More specifically, the bias assembly 44 allows a dimension of the clamp opening 62 to be preset to a predetermined dimension that is slightly larger than the complementary dimension of the bearing cap 22 to facilitate mounting of the first example collar assembly 30 over the bearing cup 22 prior to operation of the clamp assembly 42 to secure the clamp member 40 onto the bearing cup 22.

B. First Example Displacing Assembly

As shown in FIGS. 8-20, the first example displacing assembly 32 comprises a base plate 120 and a draw plate 122. A main bolt assembly 130 extends between the base plate 120 to the draw plate 122, while at least one draw bolt assembly 132 connects the draw plate 120 to the first example collar assembly 30. At least one brace rod assembly 134 extends from the base plate 120, through the draw plate 122 and the first example collar assembly 30, and to the bearing casting 26. In addition, the first example displacing assembly 32 optionally comprises at least one stabilizer bolt 136 extending between the base plate 120 and the draw plate 122.

The first example displacing assembly 32 operates basically as follows. Operation of the example main bolt assembly 130 displaces the draw plate 122 towards and away from the base plate 120. The example draw bolt assemblies 132 transfer movement of the draw plate 122 to the first example collar assembly 30. The example brace rod assemblies 134 prevent movement of the base plate 120 towards the bearing casting 26 when the first example bearing cup puller 20 is in use. The brace rod assemblies 134 further guide movement of the draw plate 122 and first example collar assembly 30 during operation of the first example bearing cup puller 20.

The details of construction and operation of the first example displacing assembly 32 will now be described in further detail.

The example base plate 120 defines a base plate main through opening 140, at least one base plate brace opening 142, and at least one base plate stabilizer opening 144. The draw plate 122 defines a draw plate main threaded opening 150, at least one draw plate brace through opening 152, at least one draw plate stabilizer opening 154, and at least one draw plate draw opening 156.

The main bolt assembly 130 comprises a main bolt 160, a main washer 162, and a main bolt retainer 164. The main bolt 160 defines a main bolt head 166 and a main bolt shaft 168. The main bolt shaft 168 is sized and dimensioned to extend through the base plate main through opening 140 and threaded to engage the draw plate main threaded opening 150. The main washer 162 is arranged between the main bolt head 160 and a first side of the base plate 120 such that tension loads on the main bolt 160 are applied through the main bolt head 166 and the main washer 162 to the base plate 120. The main bolt retainer 164 engages a slot **168*a* in the shaft 168 and is adjacent to a second side of the base plate 120. Accordingly, axial rotation of the main bolt 160 in a first direction thus displaces the draw plate 122 towards the base plate 120, while axial rotation of the main bolt in a second direction thus displaces the draw plate 122 away from the base plate 120. The main bolt 160** defines a main axis A.

The example draw bolt assembly 132 comprises a draw bolt 170 and a draw bolt retainer 172. The draw bolt 170 defines draw bolt head 174, a draw bolt first shaft portion 176, and a draw bolt second shaft portion 178. The draw bolt head 174 engages a portion of the clamp member 40 within the draw opening 68 to transfer tension loads on the draw bolt 170 to the clamp member 40. The draw bolt second shaft portion 178 engages the draw plate opening 156. The draw bolt retainer 172 secures the draw bolt head 174 within at least a portion of the draw opening 68. So connected, each draw bolt 170 defines a draw axis D. Movement of the draw plate 122 along the draw axis D is transferred through the draw bolt 170 to the clamp member 40.

The example brace rod assembly 134 comprises a brace rod 180 and a brace rod screw 182. A first end of the brace rod 180 defines a screw opening 184. The brace rod screw 182 defines a screw head 186 and a screw shaft 188. The first end of the brace rod 180 is at least partly received within the base plate brace opening 142, and the shaft 188 of the brace rod screw 182 extends through a portion of the base plate opening 142 and into the screw opening 184 to secure the first end 180 of the brace rod 180 to the base plate 120. The brace rod 180 further extends through the draw plate brace through opening 154 and clamp member draw opening 68 such that a second end of the brace rod 180 is capable of engaging the bearing casting 26 during use of the first example bearing cup holder 20. Each brace rod 180 defines a brace axis G.

The example stabilizer bolt 136 defines a stabilizer bolt head 190, a stabilizer bolt first shaft portion 192, and a stabilizer bolt second shaft portion 194. The stabilizer bolt second shaft portion 194 is threaded to engages the threaded base plate stabilizer opening 144 such that a position of the stabilizer bolt 136 is fixed relative to the base plate 120 and defines a stabilizer axis S. The stabilizer bolt first shat portion 192 extends at least partly into the draw plate stabilizer opening 154 such that the draw plate 122 may move along the stabilizer axis S relative to the base plate 120 but the draw plate 122 may not rotate about the main axis A relative to the base plate 120.

Figure 14:
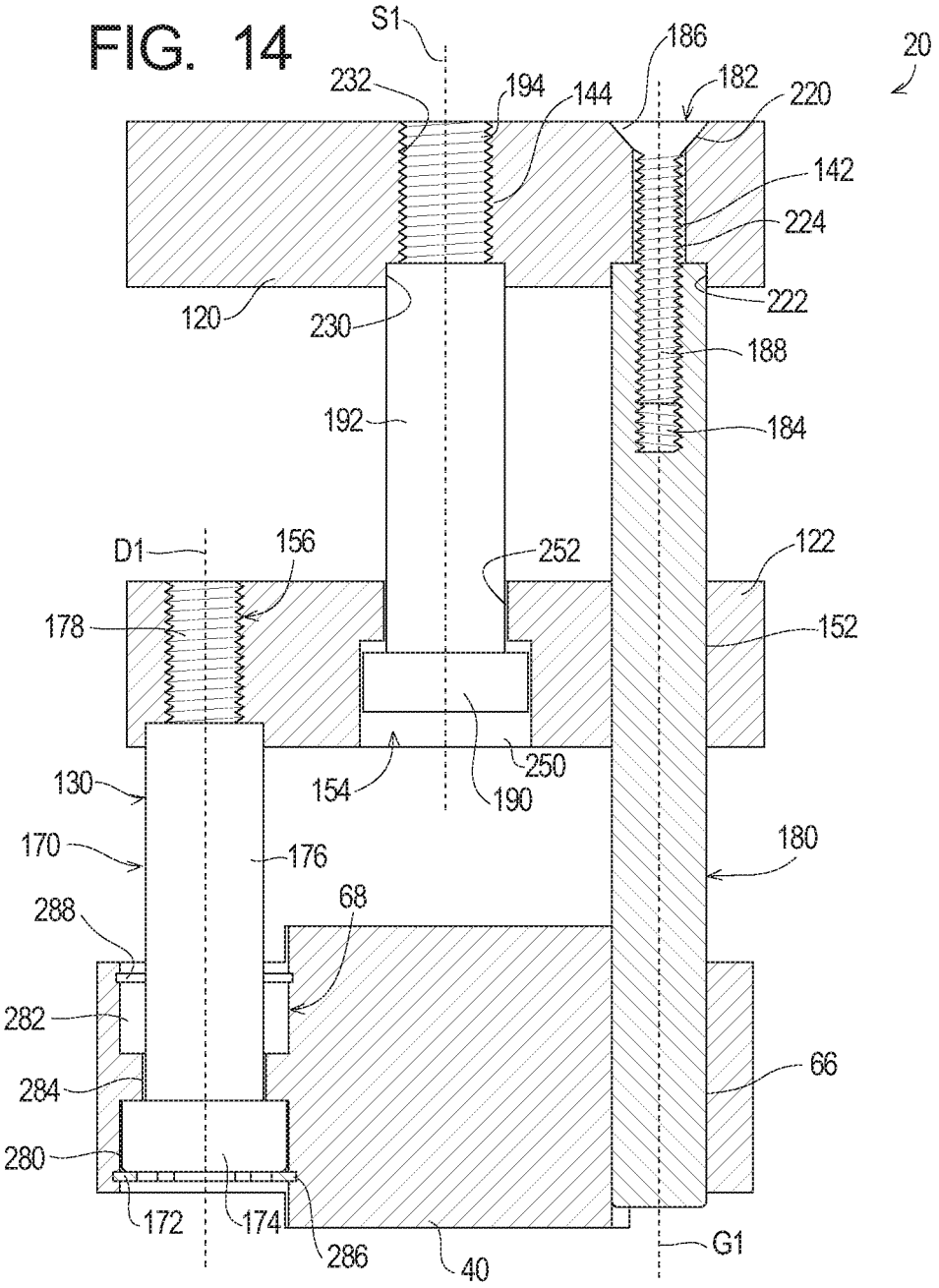
FIG. 14 is a section view taken along lines 14-14 in FIG. 10.

FIG. 14 illustrates that the base plate brace openings 142 formed in the base plate 120 define a base plate opening first portion 220, a base plate opening second portion 222, and a base plate brace opening intermediate portion 224. A diameter of the base plate brace second portion 222 is larger than that of the base plate brace opening intermediate portion 224 to provide a shoulder that engages the first end of the brace rod 170. The base plate opening first portion 220 is flared or otherwise countersunk to receive the brace rod screw head 186 such that the brace rod screw 182 secures the brace rod 180 in place relative to the base plate 120.

FIG. 14 further illustrates that the base plate brace opening 142 comprises a base plate stabilizer opening first portion 230 and a base plate stabilizer opening second portion 232. The base plate stabilizer opening first portion 230 is threaded to receive the threaded stabilizer bolt second shaft portion 194, while a diameter of the base plate stabilizer opening second portion 232 is larger than that of the base plate stabilizer opening first portion 230 to create a shoulder against which the stabilizer bolt first shaft portion 192 is braced when the stabilizer bolt 136 is fully threaded into the base plate 120.

FIG. 14 also shows that the draw plate stabilizer opening 154 comprises a draw plate stabilizer opening first portion 250 and a draw plate stabilizer opening second portion 252. The draw plate stabilizer opening first portion 250 is a through opening sized and dimensioned to accommodate the stabilizer bolt first shaft portion 182. The draw plate stabilizer opening second portion 252 is a through opening sized and dimensioned to accommodate the stabilizer bolt head portion 190. A diameter of the draw plate stabilizer opening first portion 250 is greater than that of the draw plate stabilizer opening second portion 252 such that the stabilizer bolt head portion 190 may not pass through the draw plate stabilizer opening second portion 252. The draw plate 122 thus freely moves along the stabilizer axis S defined by the stabilizer bolt 136 but engages the stabilizer bolt to prevent rotation of the draw plate 122 about the main axis A.

FIG. 13 illustrates that the example biasing transfer member 90 defines a transfer member head portion 260 and a transfer member shaft portion 262. The transfer member head portion 260 is slightly smaller than a diameter of the bias opening 76 such that the transfer member head portion 260 may enter at least partly within the bias opening 76. The transfer member shaft portion 262 extends through the biasing member 94 and the bias washer retainer 98 to center the bias transfer member 90 within the bias opening 76.

The example bias set screw 92 defines a set screw shaft portion 264 and a set screw drive end 266. The set screw shaft portion 264 is threaded to engage the adjustment threaded opening 74 such that axial rotation of the bias set screw 92 causes movement of the bias set screw 92 towards and away from the biasing transfer member 90. The set screw drive end 266 facilitates axial rotation of the bias set screw 92. The bias set screw 92 allows adjustment of the bias force generated by the biasing member 94 to separate the first and second clamp projections 56 and 58 prior to axial rotation of the clamp bolt 80 to clamp the clamp member 40 onto the bearing cap 22.

Figure 15:
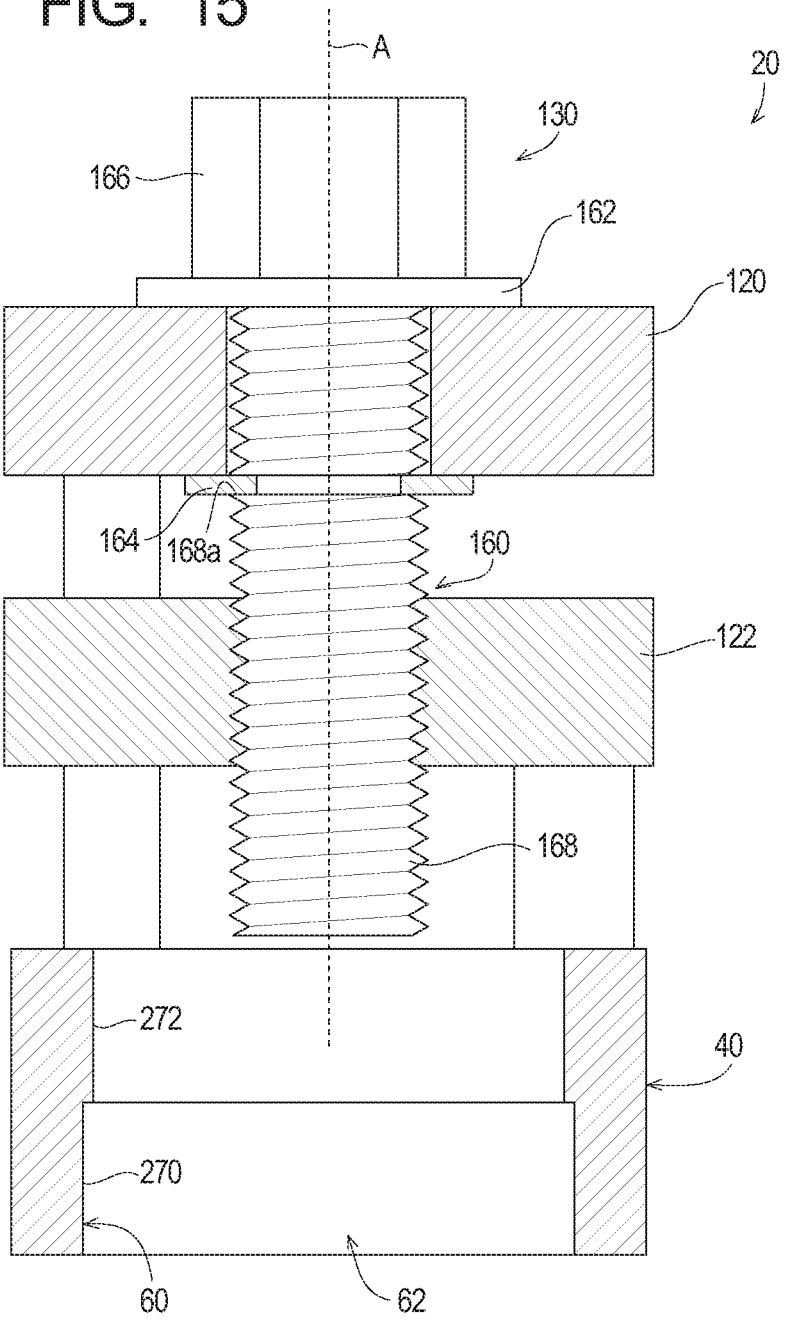
FIG. 15 is a vertical partial section view of the first example bearing cup removal tool.
Figure 16:
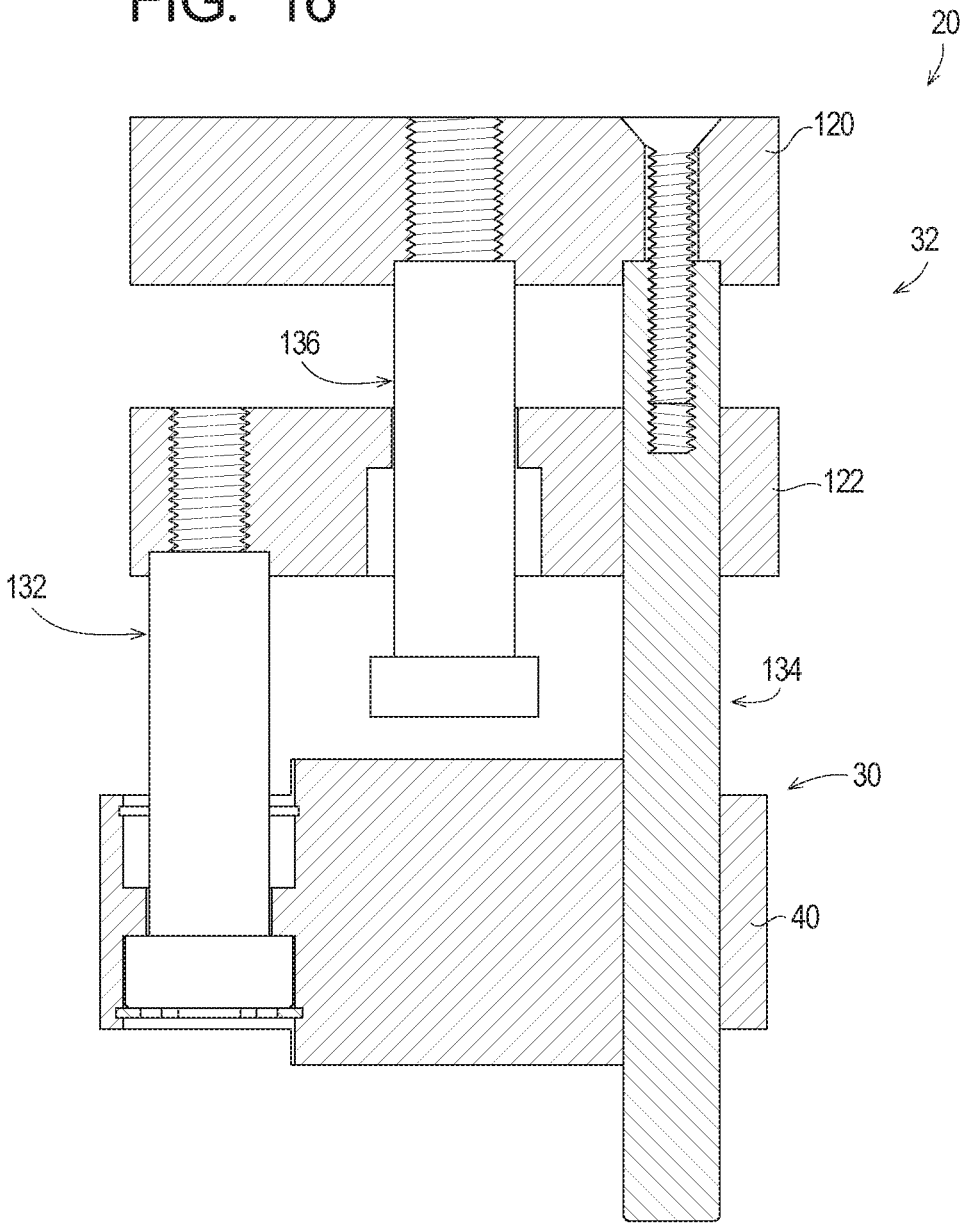
FIG. 16 is a vertical partial section view of the first example bearing cup removal tool.
Figure 17:
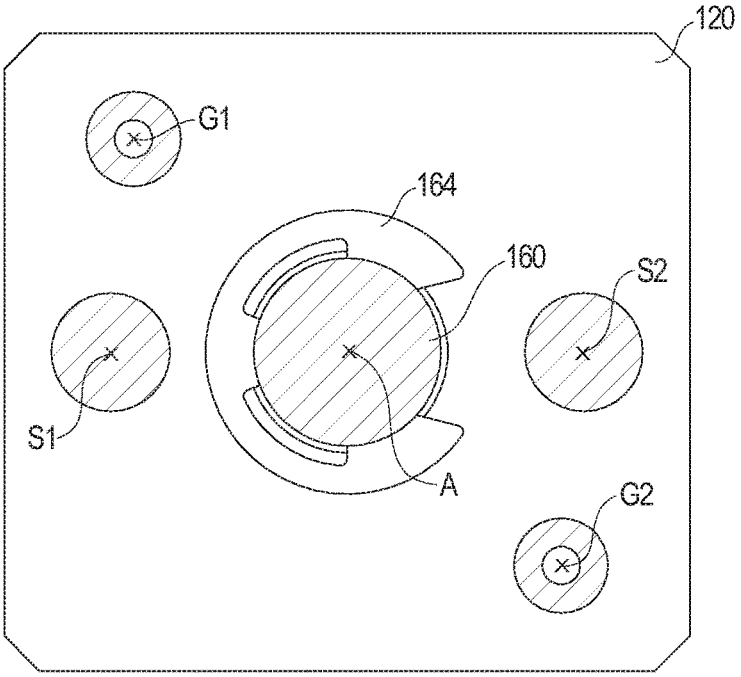
FIG. 17 is a section view taken along lines 17-17 in FIG. 9.
Figure 18:
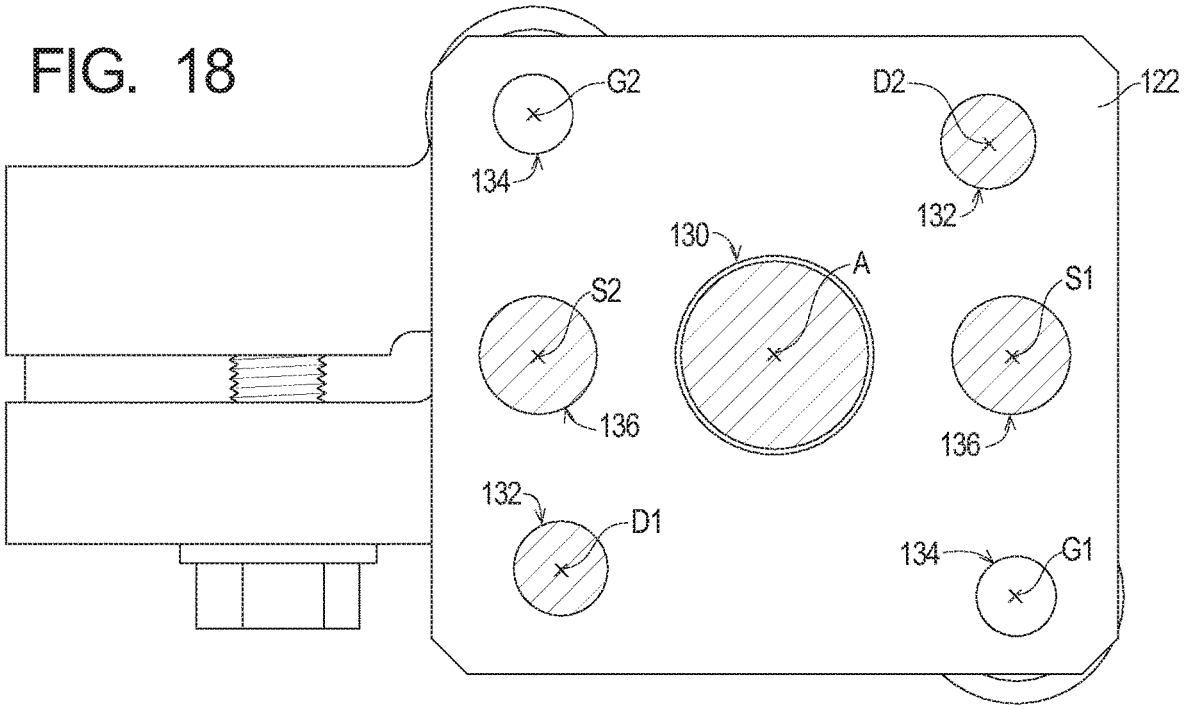
FIG. 18 is a section view taken along lines 18-18 in FIG. 9.
Figure 19:
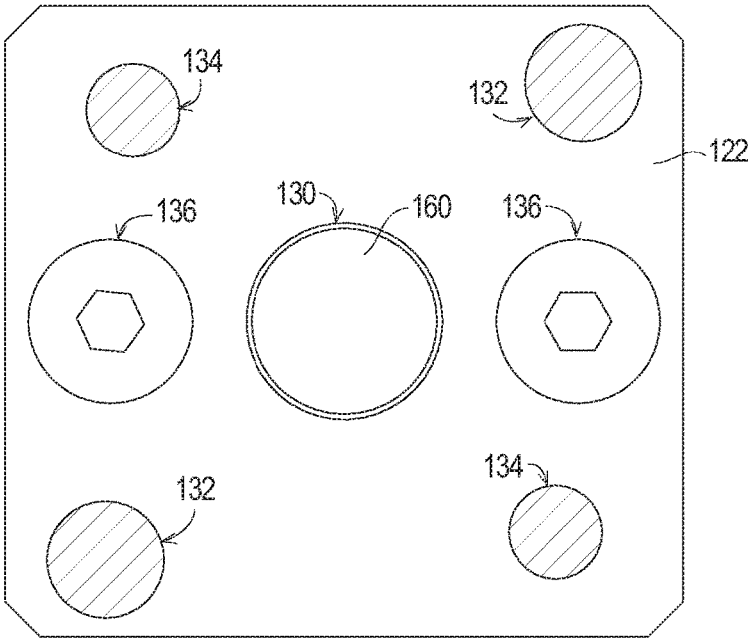
FIG. 19 is a section view taken along lines 19-19 in FIG. 9.
Figure 20:
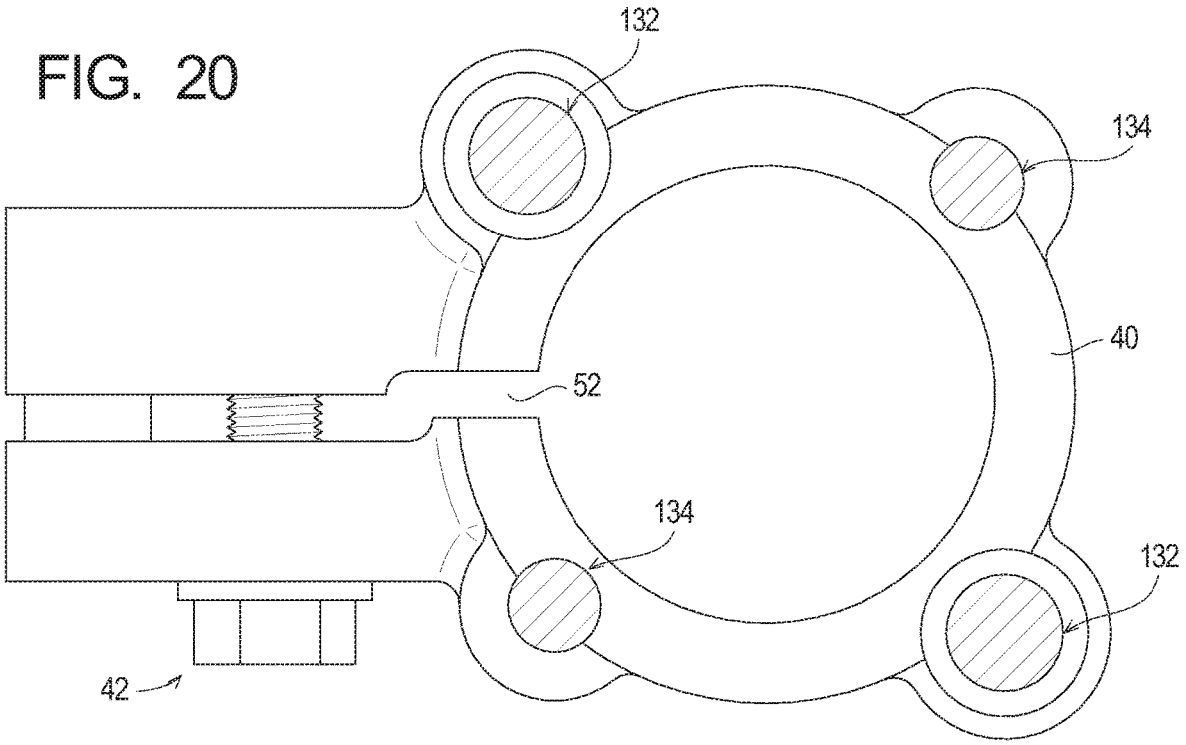
FIG. 20 is a section view taken along lines 20-20 in FIG. 9.

Referring now to FIG. 15, it can be seen that the example clamp surface 60 defines a first clamp surface portion 270 and a second clamp surface portion 272. A cross-sectional area of the first clamp surface portion 270 is predetermined to accommodate a first type of bearing cup 22, while a cross-sectional area of the second clamp surface portion 272 is predetermined to accommodate a second type of bearing cup 22. The example clamp member 40 is otherwise symmetrical and can be reversed to allow either the first clamp surface portion 270 or the second clamp surface portion 272 to be used.

In particular, FIG. 14 illustrates that the clamp member draw opening 68 defines a clamp member draw opening first end portion 280, a clamp member draw opening second end portion 282, and a clamp member draw opening intermediate portion 284. A clamp member draw opening first annular recess 286 is formed in the clamp member draw opening first end portion 280, and a clamp member opening second annular recess 288 is formed in the clamp member draw opening second portion 282. The example draw bolt head 174 is sized and dimensioned to be received in either the clamp member draw opening first end portion 280 or the clamp member draw opening second end portion 282 depending upon which clamp surface portion 270 or 272 is to be used. A diameter of the clamp member draw opening intermediate portion 284 is smaller than the diameters of the clamp member draw opening first end portion 280 and the clamp member draw opening second end portion 282 to prevent passage of the draw bolt head 174 through the clamp member draw opening 68 in either configuration. The annular recesses 286 and 288 receive the draw bolt retainer 172 to hold the draw bolt head portion 174 within the selected clamp member draw opening first end portion 280 or the clamp member draw opening second end portion 282.

The first example collar assembly 30 may thus easily be converted for use with at least two types of bearing cups 22 simply by reversing the clamp member 40 such that the appropriate clamp surface portion 270 or 272 is exposed to the bearing cup 22 to be removed.

In the first example bearing cup puller 20, a single main bolt assembly 120 and two each of the draw bolt assemblies 132, brace rod assemblies 134, and stabilizer bolts 136 are used. The main axis A defined by the main bolt 160 is substantially aligned with a central region of a substantially cylindrical shape defined by the clamp opening 62. The draw axes D, brace axes G, and stabilizer axes S are all substantially parallel to each other and to the main axis A. The draw axes D, brace axes G, and stabilizer axes S are all offset from each other and from the main axis A. This arrangement allows the main bolt 160 to be located in line with a longitudinal axis of the bearing cup 22 and axially rotated to pull the first example collar assembly 30 along the main axis A. Axial rotation of just the main bolt 160 thus acts on the draw plate 122 through the main bolt 160 and on the first example collar assembly 30 through the draw bolts 170 such that a balanced pulling action is applied on the first example collar assembly 30.

It should also be noted that more than two draw bolt assemblies 132, brace rod assemblies 134, and stabilizer bolts 136 may be provided. Further, a single draw bolt assembly 132 and brace rod assembly 134 may be used but may create an unbalanced pulling action on the first example collar assembly 30. The stabilizer bolt or bolts 136 are optional and may be omitted but also contribute to the application of a balanced pulling action on the first example collar assembly 30.

II. Second Example Bearing Cup Removal Tool

Referring to FIGS. 21-24 of the drawing, depicted therein is a second example bearing cup removal tool 320 of the present invention. The first example bearing cup removal tool 320 may be used to remove a bearing cup 322 of a bearing cup assembly 324. The bearing assembly 324 is not per se part of the present invention and will be described herein only to that extent necessary for a complete understanding of the present invention.

Figure 21:
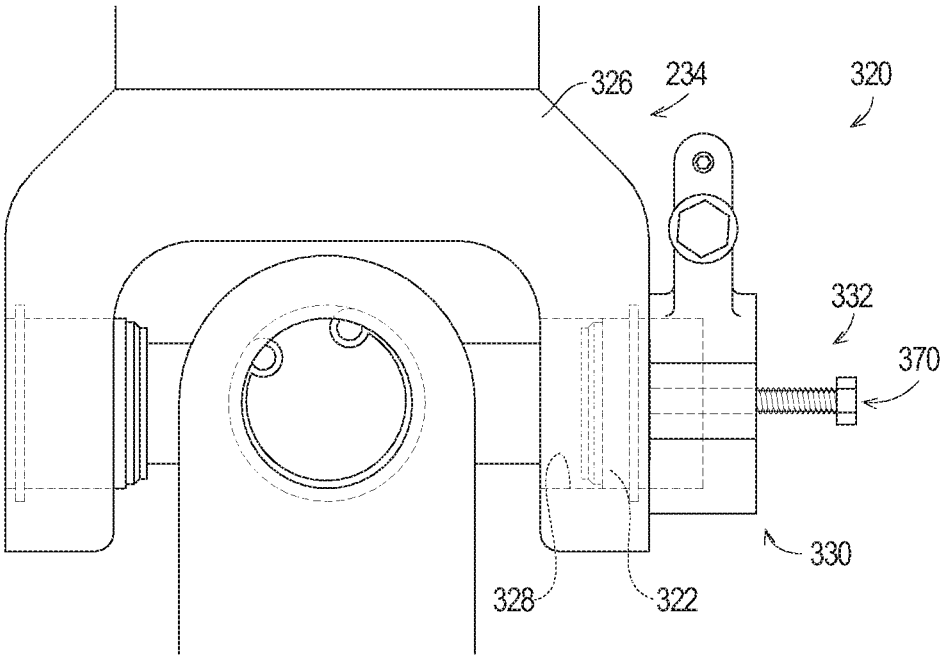
FIG. 21 is a top plan view of a second example bearing cup removal tool of the present invention.

The example bearing assembly 324 comprises a bearing casting 326 defining a bearing cup opening 328. When fully assembled, the bearing cup 322 resides within the bearing cup opening 328. During the process of disassembling the bearing assembly 324, the bearing cup 322 is displaced relative to the bearing casting 326 such that the bearing cup 322 partly protrudes from the bearing cup opening 328 as shown in FIG. 21. The first example bearing cup removal tool 320 is used to remove the bearing cup 322 from the bearing cup opening 328.

Figure 24:
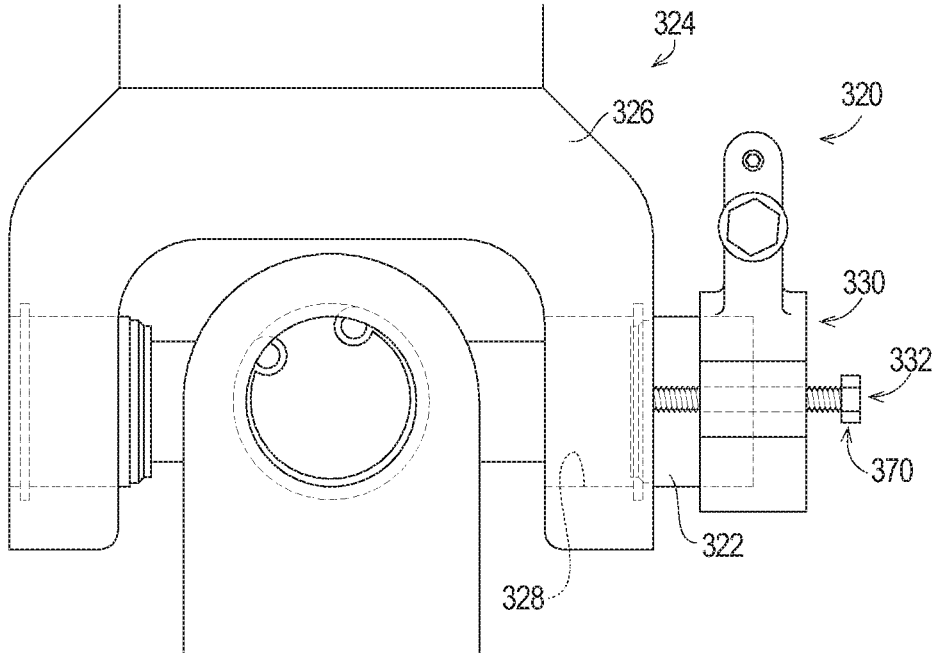
FIG. 24 is a vertical partial section view of the second example bearing cup removal tool.

The second example bearing cup removal tool 320 comprises a second example collar assembly 330 and a second example displacing assembly 332. The collar assembly 330 is clamped onto the protruding portion of the bearing cup 322 as shown in FIG. 21, and the second example displacing assembly 332 is operated to displace the bearing cup 322 relative to the bearing casting 326 until the bearing cup 322 is completely removed from the bearing cup opening 28 as shown in FIG. 24. The collar assembly 330 is then unclamped from the bearing cup 322. The use of the bearing cup removal tool 320 simplifies the process of removing the bearing cup 322 from the bearing cup opening 328 while minimizing or eliminating damage to the bearing cup 322 and the bearing cup casting 326.

With the foregoing general understanding of the principles of the present invention in mind, the details of the first example bearing cup removal tool will now be described.

A. Second Example Collar Assembly

Figure 22:
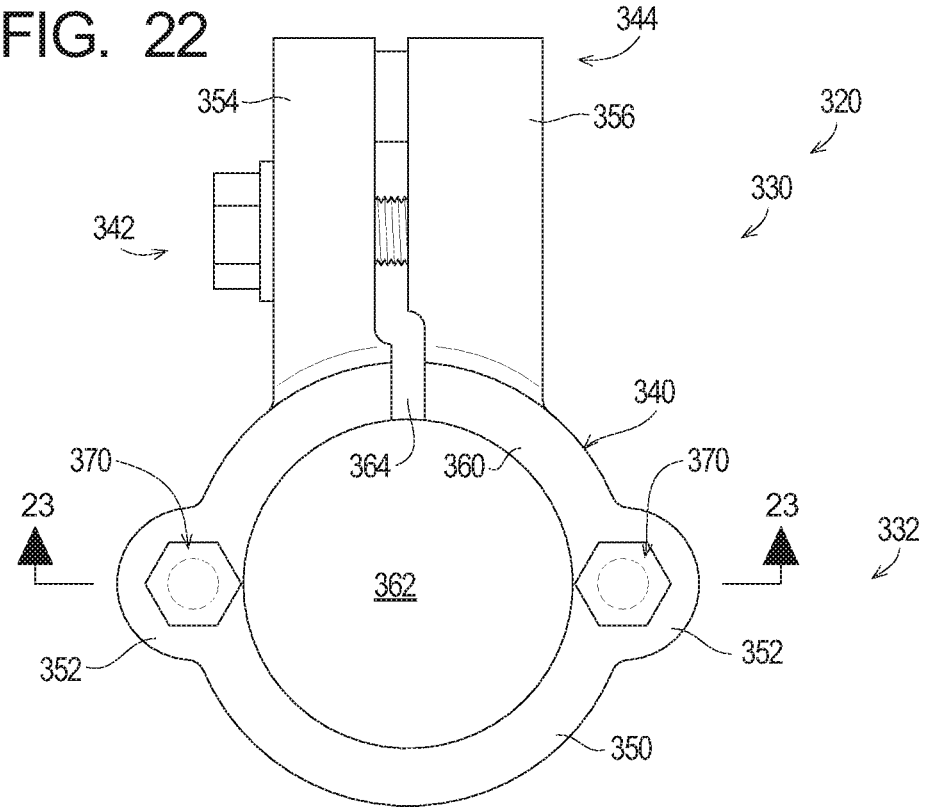
FIG. 22 is a side elevation view of the second example bearing cup removal tool.
Figure 23:
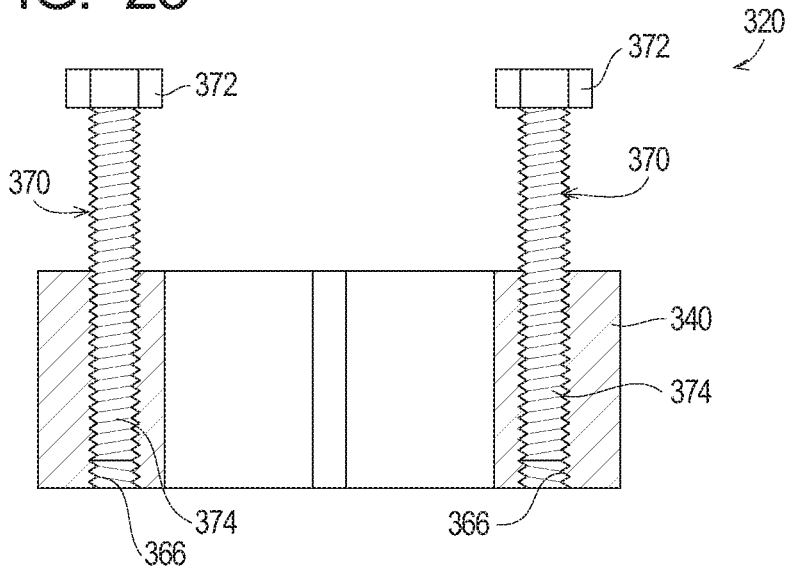
FIG. 23 is a vertical partial section view of the second example bearing cup removal tool.

Referring now to FIGS. 22-24, the second example collar assembly 330 will initially be described. The second example collar assembly 330 comprises a clamp member 340, a clamp assembly 342, and, optionally, a bias assembly 344. The clamp member 340 is configured to surround at least a portion of the bearing cup 322. The clamp assembly 342 acts on the clamp member 340 to cause the clamp member to frictionally engage the bearing cup 322. The optional bias assembly 344 allows a configuration of the clamp member 340 to be preset such that the clamp member 340 may easily be arranged to surround at least a portion of the bearing cup 322 prior to operation of the clamp assembly 342.

The example clamp member 340 comprises a main portion 350, at least one displacement portion 352, a first clamp projection 354, and a second clamp projection 356. The main portion 350 of the example clamp member 340 further defines an internal clamp surface 360 defining a clamp opening 362. The example clamp surface 360 is generally cylindrical but is discontinuous at a clamp member split gap 364. The first and second projections 356 and 358 extend from the main portion 350 on either side of the clamp member split gap 364. Each displacement portion 352 of the example clamp member 340 defines a threaded displacement opening 366.

The clamp assembly 342 and optional bias assembly 344 may be constructed and operated in the same manner as the clamp assembly 42 and bias assembly 44 described above and thus will not be described in detail herein.

B. Second Example Displacing Assembly

As shown in FIG. 23, the second example displacing assembly 332 comprises at least one displacement bolt 370. The displacement bolt 370 defines a head portion 372 and a threaded shaft 374. The threaded shafts 374 are adapted to engage the threaded displacement opening 366 such that axial rotation of the displacement bolt 370 displaces the displacement bolt 370 relative to the clamp member 340.

With the clamp member 340 clamped on to the bearing cup 322, axial rotation of the displacement bolt 370 in a first direction causes the end of the bolt shaft 374 to come into contact with the bearing casting 326. FIG. 21 illustrates the configuration of the displacement bolt 370 when the displacement bolt 370 initially comes into contact with the bearing casting 326, although the contact between the displacement bolt 370 and the bearing casting 326 is not visible in FIG. 21. Continued axial rotation of the displacement bolt 370 in the first direction causes the displacement bolt 370 to act on the bearing casting 326 such that the clamp member 340 and the bearing cup 322 on which the clamp member 340 is clamped are displaced away from the bearing casting 326 as shown in FIG. 24.

The example clamp member 340 defines two of the displacement openings 366, and the example displacing assembly 332 employs two of the displacement bolts 370. The example displacement openings 366 are arranged on opposite sides of the clamp opening 362. With this configuration, the displacement bolts 370 are alternately axially rotated in an alternating sequence such that each displacement bolt 370 is displaced only a short distance at a time. By alternating the sequence in which the displacement bolts 370 are advanced, the displacing force applied on the second example collar assembly 330 can be balanced sufficiently to remove the bearing cup 322 from the bearing cup opening 328 without damage to the bearing cup 322 or bearing casting 326.

III. Third Example Collar Assembly

Figure 25:
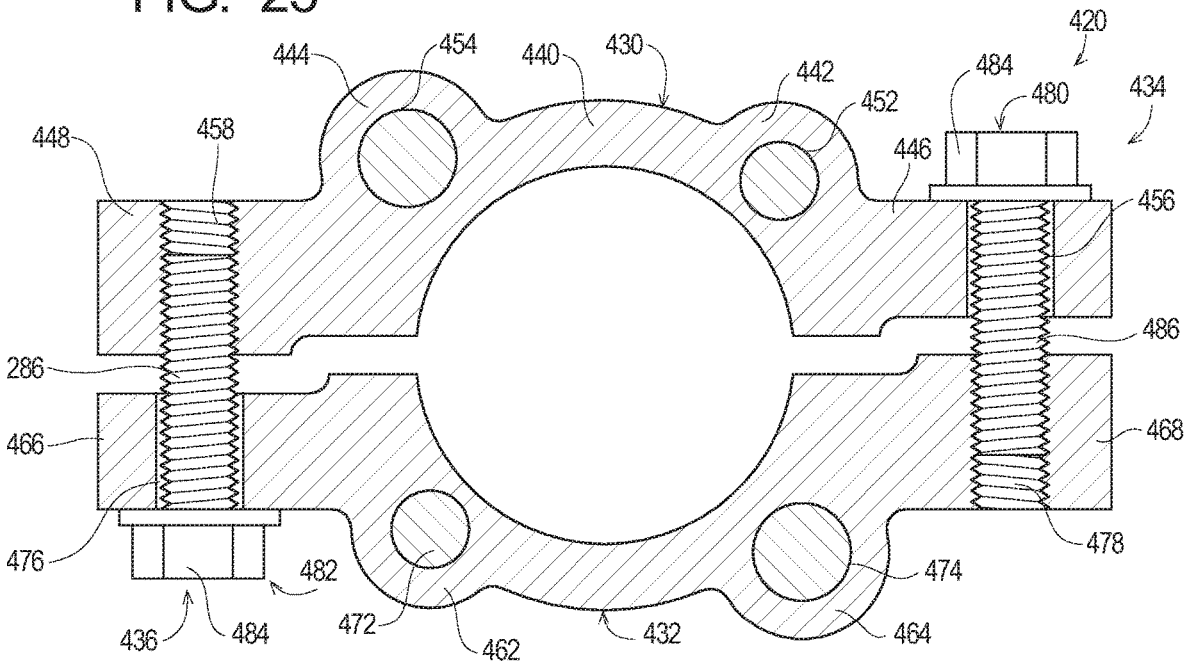
FIG. 25 is a top plan partial section view of a second example collar assembly that may be used by a bearing cup removal tool of the present invention, including either of the first and second example bearing cup removal tools described herein.

Referring now to FIG. 25, a third example collar assembly 420 will now be described. The third example collar assembly 420 comprises first and second clamp members 430 and 432 and first and second clamp assemblies 434 and 436. The clamp members 430 and 432 are configured to surround at least a portion of a bearing cup such as the bearing cups 22 and 322 described above. The clamp assemblies 434 and 436 act on the clamp members 430 and 432 to cause the clamp members 430 and 432 to frictionally engage the bearing cup.

The example first clamp member 430 comprises a first main portion 440, a first clamp brace portion 442, a first clamp draw portion 444, a first clamp projection 446, and a second clamp projection 448. The first main portion 440 of the first clamp member 430 defines a first clamp surface 450. A first clamp member brace through opening 452 is formed in the first clamp brace portion 442, while a first clamp draw opening 454 is formed in the first clamp draw portion 444. The first clamp projection 446 defines a first clamp through opening 456, while the second clamp projection 448 defines a first clamp threaded opening 458.

The example second clamp member 432 comprises a second main portion 460, a second clamp brace portion 462, a second clamp draw portion 464, a third clamp projection 466, and a fourth clamp projection 468. The second main portion 460 of the second clamp member 432 defines a second clamp surface 470. A second clamp member brace through opening 472 is formed in the second clamp brace portion 462, while a second clamp draw opening 474 is formed in the second clamp draw portion 464. The third clamp projection 466 defines a second clamp through opening 476, while the fourth clamp projection 468 defines a second clamp threaded opening 478.

The example first clamp assembly 434 comprises a first clamp bolt 480 and a second clamp bolt 482. The example first and second clamp bolts 480 and 482 are identical and each defines a clamp bolt head 484 and a clamp bolt shaft 486.

To form the third example collar assembly 420, the first clamp through opening 456 is aligned with the second clamp threaded opening 478 and the first clamp threaded opening 458 is aligned with the second clamp through opening 476. The first clamp bolt 480 is inserted through the first clamp through opening 456 and threaded into the second clamp threaded opening 478, while the second clamp bolt 482 is inserted through the second clamp through opening 476 and threaded into the first clamp threaded opening 458. At this point, a clamp opening 490 is formed, a first clamp gap 492 is formed between the first clamp projection 446, and the fourth clamp projection 468, and a second clamp gap 494 is formed between the second clamp projection 448 and the third clamp projection 466. In the example collar assembly 420, the first and second clamp gaps 492 and 494 are arranged on opposite sides of the clamp opening 490, but other configurations may be used as well.

Axial rotation of the first clamp bolt 480 causes the threaded shaft portion 486 thereof to engage the second clamp threaded opening 478, while axial rotation of the second clamp bolt 482 causes the threaded shaft portion 486 thereof to engage the first clamp threaded opening 458. At this point, axial rotation of the first and second clamp bolts 480 and 482 in a first direction displaces the first and second clamp members 440 and 442 towards each other, while axial rotation of the first and second clamp bolts 480 and 482 in a second direction allows the first and second clamp members 440 and 442 to be displaced away from each other.

The third example clamp assembly 420 is secured to the bearing cup by arranging at least a portion of the bearing cup within the clamp opening 490 and axially rotating the first and second clamp bolts 480 and 482 such that the first and second clamp surfaces 450 and 470 frictionally engage the bearing cup. At this point, the third example collar assembly 420 may be displaced away from the bearing casting to remove the bearing cup from the bearing opening.

The third example clamp assembly 420 is configured to be used with the first example displacing assembly 32 described above. However, the third example clamp assembly 420 may easily be configured to be used with the second example displacing assembly 332 described above.

What is claimed is:

1. A bearing cup removal tool for removing a bearing cup from a bearing casting, the bearing cup removal tool comprising:

a collar assembly comprising a clamp member defining a clamp surface, and a clamp assembly; and a displacing assembly; whereby the clamp assembly deforms the clamp member to alter a shape of the clamp surface such that the clamp member is configured to surround at least a portion of the bearing cup, and the clamp member is configured to frictionally engage at least the portion of the bearing cup to secure the clamp member to the bearing cup; and the displacing assembly engages the clamp member and is adapted to engage the bearing casting such that operation of the displacing assembly forces the clamp member away from the bearing casting.

2. The bearing cup removal tool as recited in claim 1, in which the displacing assembly comprises:

a base plate;

a draw plate;

at least one main bolt operatively connected to the base plate and the clamp member such that rotation of the at least one main bolt displaces the clamp member relative to the base plate; and at least one brace rod extending from the base plate and through the draw plate;

wherein the at least one brace rod is adapted to engage the bearing casting when operation of the displacing assembly forces the clamp member away from the bearing casting.

3. The bearing cup removal tool as recited in claim 2, in which the displacing assembly further comprises:

at least one draw bolt extending between the draw plate and the clamp member such that movement of the draw plate displaces the clamp member;

wherein the at least one main bolt extends between the base plate and the draw plate such that rotation of the at least one main bolt displaces the draw plate relative to the base plate.

4. The bearing cup removal tool as recited in claim 2, in which the displacing assembly further comprises at least one stabilizer bolt extending between the base plate and the draw plate.

5. The bearing cup removal tool as recited in claim 1, in which the displacing assembly comprises at least one displacement bolt that engages the clamp member and is adapted to engage the bearing casting such that rotation of the at least one displacement bolt displaces the clamp member away from the bearing casting.

6. The bearing cup removal tool as recited in claim 1, in which:

the clamp member defines a split gap; and the clamp assembly comprises a clamp bolt arranged across the split gap such that rotation of the clamp bolt deforms the clamp member to alter the shape of the clamp surface.

7. The bearing cup removal tool as recited in claim 1, in which the clamp assembly further comprises a biasing member arranged to bias the shape of the clamp surface to facilitate arrangement of the clamp member over the bearing cup.

8. A bearing cup removal tool for removing a bearing cup from a bearing casting, the bearing cup removal tool comprising:

a collar assembly comprising a clamp assembly comprising a clamp member defining a split gap and a clamp surface, and a clamp bolt arranged across the split gap; and a displacing assembly; whereby rotation of the clamp bolt in a first direction relative to the clamp member deforms the clamp member to alter a shape of the clamp surface such that the clamp member is configured to surround at least a portion of the bearing cup;

rotation of the clamp bolt in a second direction relative to the clamp member deforms the clamp member to alter the shape of the clamp surface such that the clamp member frictionally engages at least the portion of the bearing cup to secure the clamp member to the bearing cup; and the displacing assembly engages the clamp member and is adapted to engage the bearing casting such that operation of the displacing assembly forces the clamp member away from the bearing casting.

9. The bearing cup removal tool as recited in claim 8, in which the displacing assembly comprises:

a base plate;

a draw plate;

at least one main bolt operatively connected to the base plate and the clamp member such that rotation of the at least one main bolt displaces the clamp member relative to the base plate; and at least one brace rod extending from the base plate and through the draw plate;

wherein the at least one brace rod is adapted to engage the bearing casting when operation of the displacing assembly forces the clamp member away from the bearing casting.

10. The bearing cup removal tool as recited in claim 9, in which the displacing assembly further comprises:

at least one draw bolt extending between the draw plate and the clamp member such that movement of the draw plate displaces the clamp member;

wherein the at least one main bolt extends between the base plate and the draw plate such that rotation of the at least one main bolt displaces the draw plate relative to the base plate.

11. The bearing cup removal tool as recited in claim 10, in which the displacing assembly further comprises at least one stabilizer bolt extending between the base plate and the draw plate.

12. The bearing cup removal tool as recited in claim 8, in which the displacing assembly comprises at least one displacement bolt that engages the clamp member and is adapted to engage the bearing casting such that rotation of the at least one displacement bolt displaces the clamp member away from the bearing casting.

13. The bearing cup removal tool as recited in claim 8, in which the clamp assembly further comprises a biasing member arranged to bias the shape of the clamp surface to facilitate arrangement of the clamp member over the bearing cup.

* * * * *